US005158184A

United States Patent [19]

Craft et al.

[11] Patent Number: 5,158,184

[45] Date of Patent: Oct. 27, 1992

[54] DISH RACK AND DRAIN TRAY ASSEMBLY

[75] Inventors: Charles W. Craft, Apple Creek; Stacy L. Wolff, Akron, both of Ohio

[73] Assignee: Rubbermaid Incorporated, Wooster, Ohio

[21] Appl. No.: 818,879

[22] Filed: Jan. 10, 1992

[51] Int. Cl.[5] ..... A47F 7/00

[52] U.S. Cl. ..... 211/41; D32/55

[58] Field of Search ..... 211/41, 126; D32/55, D32/56, 57

[56] References Cited

U.S. PATENT DOCUMENTS 3,217,890 11/1965 Maslow ..... 211/41

*Primary Examiner*—Robert W. Gibson, Jr.

*Attorney, Agent, or Firm*—Richard B. O'Planck

[57] ABSTRACT

A dish draining rack and drain tray assembly is disclosed comprising a dish rack (4) having handles (38) extending outwardly from opposite ends, and a central dish receiving compartment for stackably receiving dishes. A tray (2) is further provided which dually functions as a tray below the rack for collecting drainage water therefrom, or as a lid for attachment to the top of the rack, whereby enclosing the rack central compartment. Positively engaging attachment means (36,38) is further disclosed for attaching the tray (2) to the rack (4), which can then function as a storage container if so desired by the user.

9 Claims, 3 Drawing Sheets

DISH RACK AND DRAIN TRAY ASSEMBLY

BACKGROUND OF THE INVENTION

1. Field of the Invention

This invention relates generally to dish racks used to contain wet dishes after their washing, and the drain trays typically used below such racks to collect drained off water.

2. The Prior Art.

In domestic kitchens, it is common to use a dish rack adjacent to the kitchen sink for the collection of wet dishes subsequent to the manual washing of the dishes in the sink. Typically the dishes are rinsed and placed in specialized compartments in the rack, still wet. A series of apertures and through slots extend through the bottom of the rack's compartment, through which water from the dishes is drained off by gravity.

A mat or tray, composed either of rubber or plastic, is generally sold with the rack, for intended use with the rack. The tray in use is positioned beneath the rack and includes a central platform area, bounded by raised sidewalls, on which the rack is supported. The drainage water from the racked dishes collects in the platform area, out of contact with the dishes, whereby accelerating their drying. Some trays in common use provide an outlet lip at one end of the platform area, which is draped over the sink, and from which collected water can be returned to the sink. Other trays merely collect the water in the platform area, for eventual disposition by way of evaporation.

The combined tray and rack are commonly colored coordinated, and are sold at retail as a set. To package the set, the tray is normally positioned below the rack, and both are wrapped in cellophane. The set is then shipped to the retail customer for display and sale. Alternatively, the rack and tray are shipped separately and it is the retailer who must display and sell the products as a combined set. Because of the awkward shape defined by the rack on the tray, it is prohibitively expensive to ship the set in a cardboard box or other container format.

While the above products are well accepted int he trade and have met with commercial success, several shortcomings prevent existing rack and tray sets from satisfying all of the consumer and manufacturer's needs. First, the aforementioned means for packaging the set for shipment and subsequent display are inadequate. The wrapping of the set together creates a package which is not attractive, and which can be ripped or cut in transit from the manufacturer to retailer. Secondly, the combined set is not a visible through a cellophane wrap as desired.

The alternative of shipping the two items separately is equally unattractive. Because of shipping irregularities, and retail inventory problems, the components of the set, the rack and tray, may become separated. The consumer is then left with the frustration of not finding a tray which matches the rack of preference, or vice versa.

Also, in use, the dish rack and tray may be moved from one location to another. For example, such items are typically taken on camping trips, or just in a residential relocation. The disassociation of the rack from the tray may occur in such events, which is further viewed as an inconvenience to the consumer.

Finally, it is not uncommon for the rack and tray set to be jointly sold with a related product, such as dish washing detergent, in a joint promotion. The wrapping of three items together (the rack, tray, and detergent sample) is an awkward and inefficient proposition. The disassociation of the items during transit is also not uncommon.

SUMMARY OF THE INVENTION

The present invention overcomes the above shortcomings in state of the art dish rack and tray sets. The subject dish rack is formed to conventionally have compartments for containment of wet dishes and aperture means at the base of such compartments for drainage of water therefrom. A tray is provided for optional positionment below the rack, for use in the drying of dishes, on on top of the rack for use in shipping and displaying the set, or moving the set from one location to another. The tray is provided with a central support surface surrounded by raised sidewalls, with a forward sidewall inclined to permit the easy removal of drainage water from the platform area. The top rim of the rack has integral handles formed in opposite ends which additionally function as a locking flange. The tray has correspondinly located handles formed in opposite ends which are positionable over the rack handles with the tray over the rack. Protrusions in an underside of the tray handles may be flexed into locking engagement over the rack handles, whereby securing the tray to the rack, and enclosing the dish containment compartment of the rack.

The rack and tray set may be shipped in the locked condition, with the tray secured on the rack as a lid. Additionally, promotional items may be conveniently stored in the dish compartment of the rack, secured therein by the tray. Also, post sale, the tray and rack may be re-attached to facilitate transportation, and with the tray serving as a lid, the rack may serve the dual function of a storage container for items such as dish washing supplies.

Accordingly, it is an objective of the present invention to provide a dish rack and tray set having improved means for convenient and cost efficient shipment and display.

It is a further objective to provide a dish rack and tray set having secure means for preventing disassociation of the components during shipment and display.

It is still a further objective to provide a dish rack and tray set having dual functional capabilities of a storage container.

Yet a further objective is to provide a dish rack and tray set having integral means for receiving and securing promotional items for point of sale promotion.

Another objective is to provide a dish rack and tray set having integral means for serving as a dish washing supply storage container for travel.

It is further objective to provide a dish rack and tray set, and means of packaging same, which is economical and efficient to manufacture.

These, and other objectives, which will be apparent to those skilled in the art, are achieved by a preferred embodiment which is described in detail below and which is illustrated by the accompanying drawings.

DESCRIPTION OF THE PREFERRED EMBODIMENT

Figure 1:
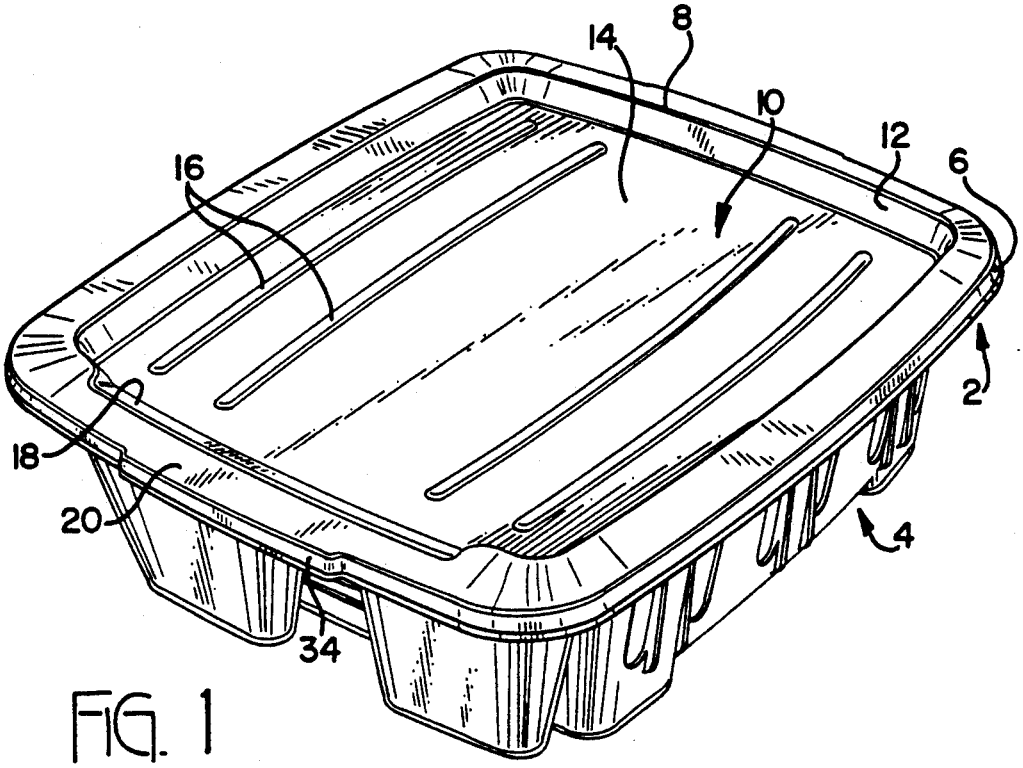
FIG. 1 is a front perspective view of the tray and rack set in the assembled condition, or use in shipment, display, or transporting articles.
Figure 4:
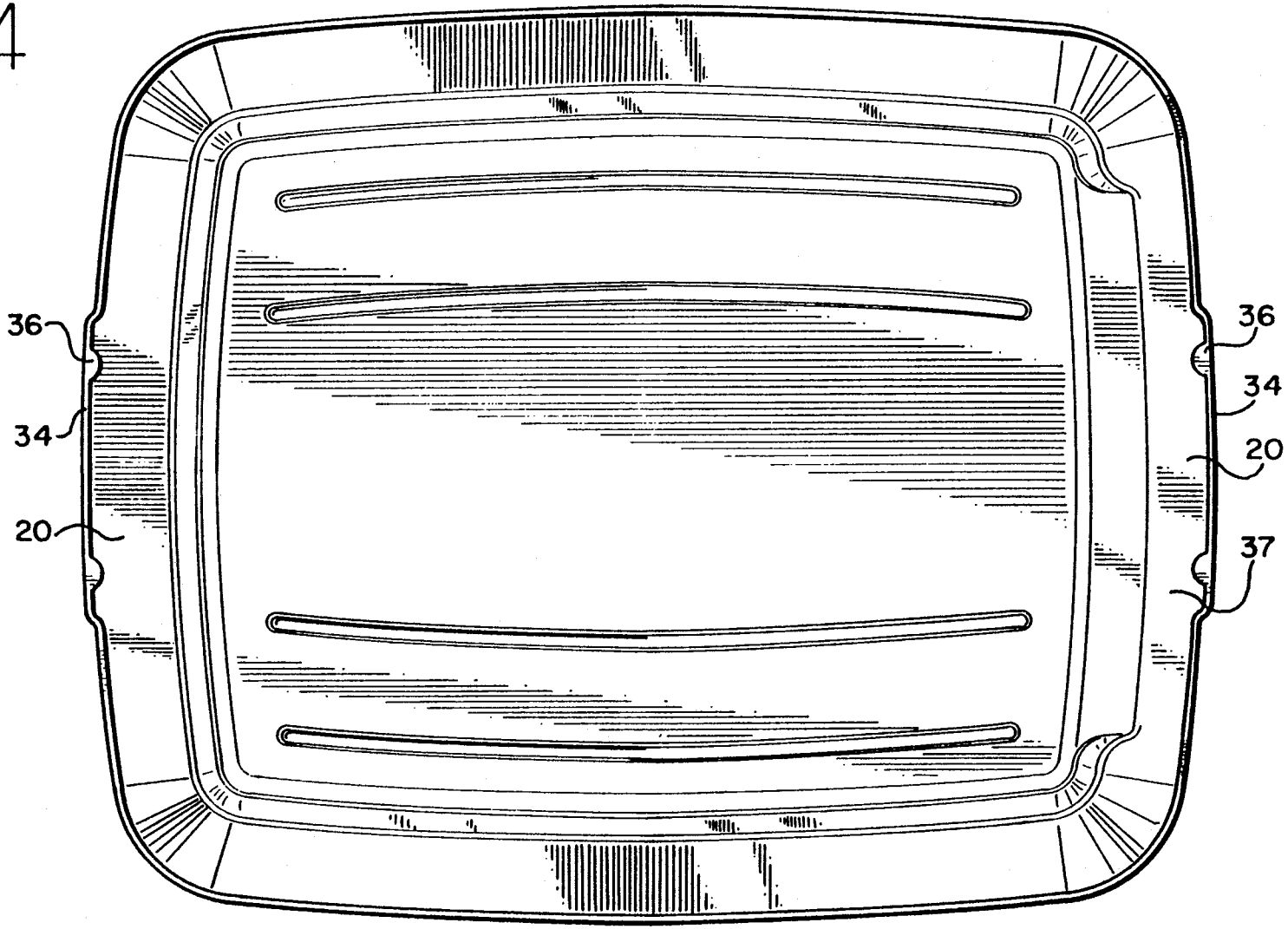
FIG. 4 is a bottom plan view of the subject tray.

Referring initially to FIGS. 1 and 4, the subject set is seen to comprise a tray 2 and a dish rack 4. The tray is generally rectangular, having downturned peripheral sidewalls 6, an upwardly inclined top surface 8 which borders the periphery of the tray, and a central recessed cavity or reservoir 10 of generally rectangular shape. The tray 2 and the rack 4 are both preferably molded of conventional plastic material, such as polyethylene.

The tray resevoir 10 is defined by beveled sidewalls 12, and a support floor 14. Longitudinal, upraised, ribs 16 extend in spaced apart fashion along the support floor 14, and an inclined end wall 18 is provided for the purposed of draining collected water out of the resevoir 10. A handle extension 20 is provided at opposite ends of the tray 2, and a dependent lip portion 34 of sidewall 6 extends along the border of each handle extension 20. As best viewed by FIG. 4, two molded protrusions 36 extend inwardly from the lip portion 34 of each handle 20, for a purpose explained below. The protrusions 36 are spaced below an underside surface 37 of the tray a distance substantially equivalent the width of the lip portion 34.

Figure 2:
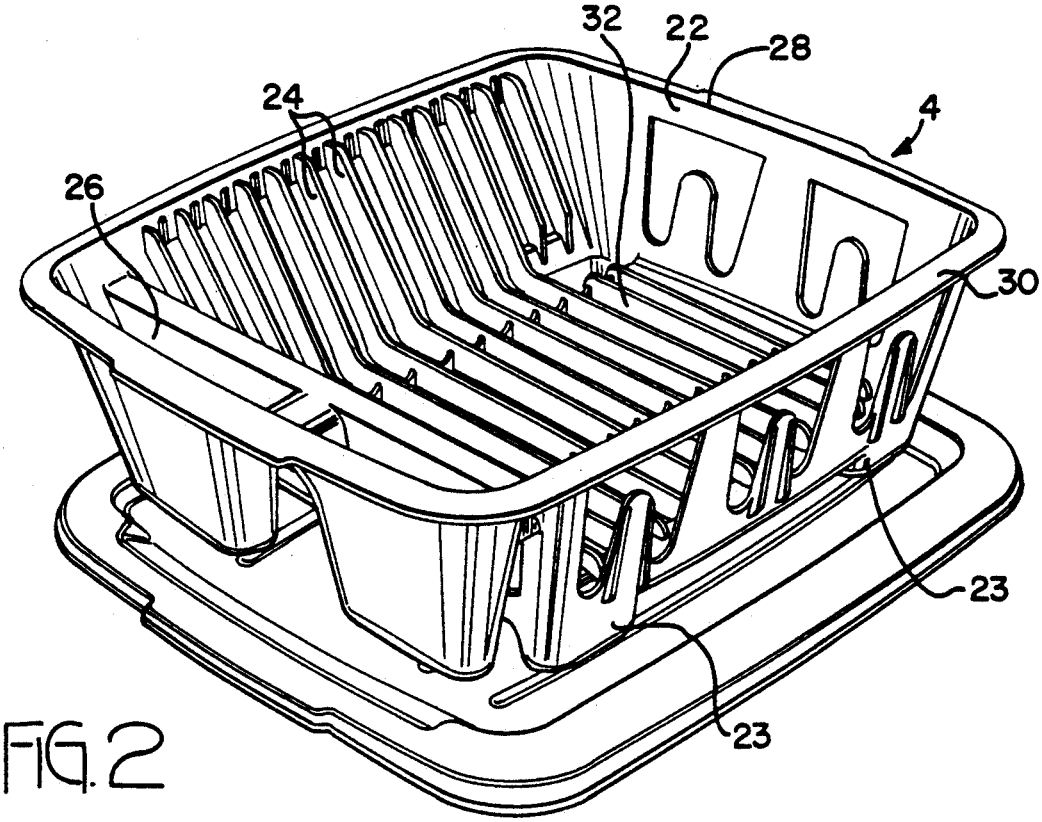
FIG. 2 is a front perspective view of the tray and rack set in the dish drying condition.
Figure 3:
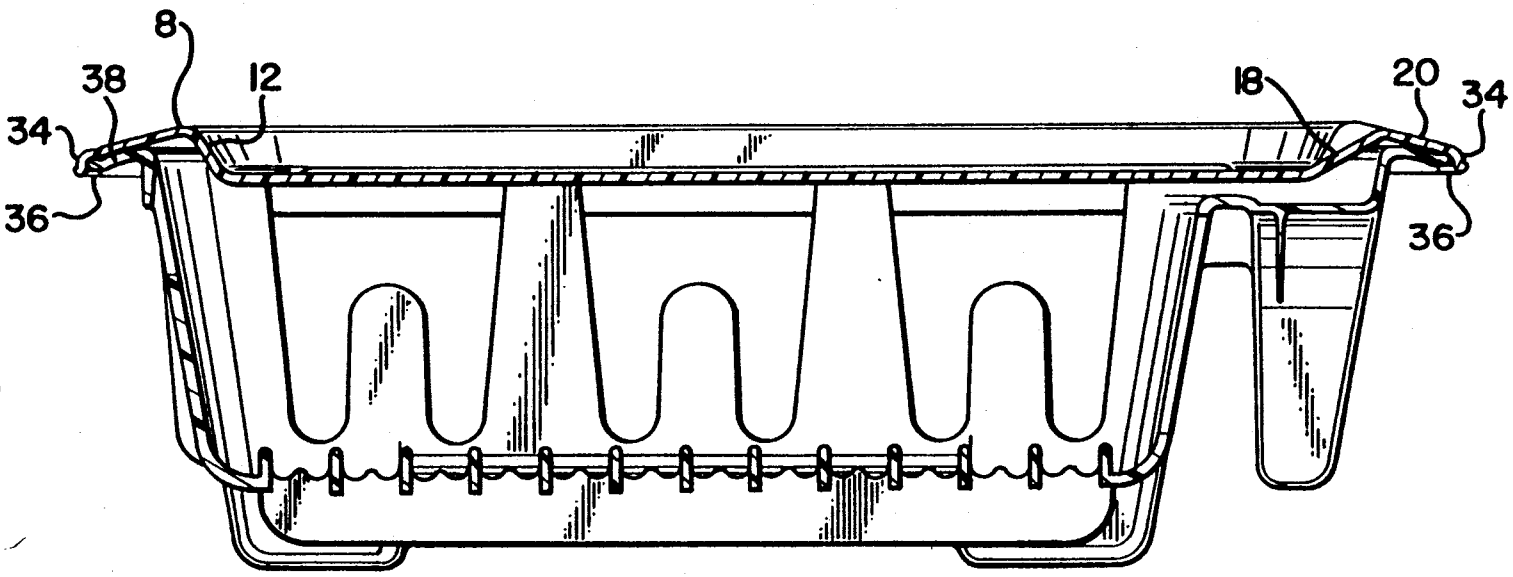
FIG. 3 is a longitudinal section view through the assembly shown in FIG. 1, taken along the line 3—3.

With continued reference to FIGS. 2 and 3, the rack of the set is configured substantially rectangular, having sidewalls 22, support legs 23 at bottom four corners, and spaced apart dish-receiving supports 24 along the interior chamber. Silverware compartments 26 are provided at a forward end. A peripheral, outwardly extending, rim flange 30 intersects the upper rim 28 of the rack at substantially a right angle. Apertures 32 between the dish supports 24, and in the floor of the silverware compartments 26 (not shown) drain water from dishes stacked in the rack, in conventional fashion. The rack is further provided with handle projections 38 at opposite ends, sized and positioned to correspond with the position and shape of the tray handles 20.

From FIGS. 1 and 3 it will be appreciated that one function which tray 2 serves is that of a lid to the rack 4. Positioned above the rack, the tray may be flexed, and protrusions 36 snapped over the handle projections 38 of the rack, whereby securely affixing the tray to the rack. The tray and rack set may then be so shipped and displayed, without risking separation. The tray is removed similarly, by flexing the body of the tray until protrusions 36 are removed from engagement over the handle projections 38.

In addition, the central compartment of the rack may function as a storage container, either prior to initial purchase or subsequently thereto by the purchaser. Prior to purchase, the rack may contain samples of complementary products for promotional purposes, secured by the tray/lid 2. Post purchase, the user may load the rack with dish cleaning supplies for a camping trip, or other small items, again, secured therein by the tray/lid 2.

FIG. 2 illustrates the tray in its second function, that for collecting drain water from the rack. The feet 23 of the rack 4 seat between the ribs 16 and upon surface 14. The water from dishes stacked in the rack will drain into the resevoir 10 of the tray 2 (FIG. 1), and collect there until it evaporates. Alternatively, the tray may be emptied by tilting the tray toward inclined surface 18, whereby spilling the contents of the resevoir 10.

It will be appreciated that the dual functions served by the tray assist both manufacturer and user. Further, the inherent flexible of the plastic material enables the tray to positively attach to the rack time after time, serving as a dependable lid therefor. Finally the capability of the tray to dually function as a lid eliminates the risk of separation of the components, which typically are color coordinated as well as functionally coordinated. This again serves the interests of both manufacturer and consumer.

While the above describes the preferred embodiment, the invention so described is not to be so restricted. Other embodiments which utilize the teachings herein set forth art intended to be within the scope and spirit of the subject invention.

We claim:

1. A dish draining rack and drain tray assembly, comprising:

dish rack having a bottom surface and sidewalls extending upwardly from the bottom surface to a top rim, said bottom surface and said sidewalls defining a top-opening dishware containing compartment, and said rack further including aperture means extending through said bottom surface for draining off liquids form dishware positioned in the compartment; and a tray positionable below said dish rack, comprising a bottom surface and sidewalls extending upwardly from the bottom surface to a top surface, and a support surface centrally disposed within said top surface for supporting said dish rack; and lower ends of said tray sidewalls enclosing said top rim of said dish rack with said tray optionally positioned upon said top rim, and said lower ends of said tray sidewalls having attachment means for engaging said dish rack, whereby securely attaching said tray to said dish rack and enclosing said dishware containing compartment.

2. An assembly according to claim 1, wherein said tray having a centrally disposed liquid containing resevoir extending downward into said top surface and terminating at said support surface.

3. An assembly according to claim 2, wherein said resevoir being defined by spaced-apart sidewalls, and one of said sidewalls comprising an inclined surface extending from said support surface of said top surface.

4. An assembly according to claim 3, wherein said tray support surface having raised ribs projecting outwardly therefrom.

5. An assembly according to claim 1, wherein said attachment means comprising:

an outwardly projecting flange extending from said rack upper rim, and protrusions formed to extend inwardly from said lower ends of said tray sidewalls, for engaging over said rack flange, whereby releasably attaching said tray to said rack.

6. A dish draining rack and drain tray assembly, comprising:

a dish rack having a bottom surface and sidewalls extending upwardly from the bottom surface to a top rim, said bottom surface and said sidewalls defining a top-opening dishware containing compartment, and said rack further including aperture means extending through said bottom surface for draining off liquids from dishware positioned in the compartment; and a tray positionable upon or beneath the dish rack at the election of the user, said tray having registration means for receiving and positioning said rack upon said tray with said tray beneath said rack, and attachment means for attaching said tray upon said rack, whereby enclosing said compartment.

7. An assembly according to claim 6, wherein said registration means comprising a centrally disposed cavity formed in an upper surface of said tray, said cavity being defined by spaced-apart sidewalls and a bottom support surface positioned and dimensioned to receive said rack thereon.

8. An assembly according to claim 7 wherein one of said sidewalls defining said cavity comprising an inclined surface extending from said support surface to said top surface.

9. An assembly according to claim 6, wherein said tray having an upper surface and spaced apart sidewalls, said attachment means comprising an outwardly projecting flange extending from said rack upper rim, and protrusions formed to extend inwardly from lower portions of said tray sidewalls for engaging over said rack flange, whereby releasably attaching said tray to said rack.

* * * * *